US012715660B2

(12) United States Patent
Seguin

(10) Patent No.: US 12,715,660 B2
(45) Date of Patent: Aug. 25, 2026

(54) RECEPTACLE FOR PRODUCTS, IN PARTICULAR COSMETIC PRODUCTS

(71) Applicant: ALBEA SERVICES, Gennevilliers (FR)

(72) Inventor: Franck Seguin, Gennevilliers (FR)

(73) Assignee: ALBEA SERVICES, Courbevoie (FR)

( * ) Notice: Subject to any disclaimer, the term of this patent is extended or adjusted under 35 U.S.C. 154(b) by 0 days.

(21) Appl. No.: 18/773,288

(22) Filed: Jul. 15, 2024

(65) Prior Publication Data

US 2025/0026541 A1 Jan. 23, 2025

(30) Foreign Application Priority Data

Jul. 18, 2023 (FR) ..... 2307669
Jan. 18, 2024 (FR) ..... 2400508

(51) Int. Cl.
*B65D 41/06* (2006.01)
*B65D 43/16* (2006.01)

(52) U.S. Cl.
CPC ..... *B65D 41/06* (2013.01); *B65D 43/165* (2013.01); *B65D 2543/00092* (2013.01)

(58) Field of Classification Search
CPC ..... B65D 41/06; B65D 43/165; B65D 2543/00092; B65D 50/064; B65D 43/0237; B65D 50/045; B65D 50/063
(Continued)

(56) References Cited

U.S. PATENT DOCUMENTS 2,192,361 A * 3/1940 Mcdonald ..... B65D 35/42 220/291
2,961,119 A * 11/1960 Leach ..... B65D 55/16 220/291

(Continued)

FOREIGN PATENT DOCUMENTS

DE 202012100969 U1 * 5/2012 ..... B65D 41/06
WO 0142101 A1 6/2001

(Continued)

OTHER PUBLICATIONS

FR2307669, "French Novelty Search Report", Jan. 31, 2024, 11 pages.

*Primary Examiner* — Orlando E Aviles
*Assistant Examiner* — Niki M Eloshway
(74) *Attorney, Agent, or Firm* — Morgan, Lewis & Bockius LLP

(57) ABSTRACT

A receptacle for a product, in particular a cosmetic product, said receptacle having an axis, referred to as longitudinal axis, and comprising a pot and a cover of said pot, said pot having first radial protrusions and second radial protrusions that are at least axially offset relative to said first protrusions of the pot, said cover has first radial protrusions and second radial protrusions that are at least axially offset relative to said second protrusions of the cover, said first protrusions of the pot and/or of the cover extending over a first portion of a circumference of said receptacle, said second protrusions of the pot and/or of the cover extending over a second portion of a circumference of said receptacle, said first and second protrusions being configured to cooperate with each other respectively so as to obtain first and second contact areas distributed over the whole of said circumference respectively, on the one hand, between the first protrusions of the pot and the first protrusions of the cover and, on the (Continued)

other hand, between the second protrusions of the pot and the second protrusions of the cover, in a closed position of said receptacle.

21 Claims, 8 Drawing Sheets

(58) Field of Classification Search
USPC ..... 220/296; 215/306, 238, 243, 332
See application file for complete search history.

(56) References Cited

U.S. PATENT DOCUMENTS 3,904,062 A * 9/1975 Grussen ..... B65D 55/16 215/258
4,548,332 A * 10/1985 Neat ..... B65D 41/34 220/268
4,991,730 A * 2/1991 Pehr ..... B65D 50/067 220/284
5,398,837 A * 3/1995 Degrassi ..... B65D 55/16 220/837
5,944,207 A * 8/1999 Reidenbach ..... B65D 41/0471 215/237
8,317,053 B2 * 11/2012 Cronin ..... B65D 43/0229 215/222
11,718,450 B2 * 8/2023 Berroa ..... B65D 41/3428 215/243
12,227,337 B2 * 2/2025 Lässer ..... B65D 41/3428
2002/0134746 A1 * 9/2002 Reidenbach ..... B65D 47/0804 215/235
2008/0053949 A1 * 3/2008 Farrar ..... B65D 41/086 215/332
2014/0076889 A1 * 3/2014 Stolzman ..... B31B 50/62 220/613
2015/0266630 A1 * 9/2015 Scott ..... B65D 41/06 215/331
2015/0314934 A1 * 11/2015 Eberlein ..... B65D 1/10 215/243
2023/0264873 A1 8/2023 Kainz et al.
2023/0322457 A1 * 10/2023 Bassi ..... B26D 3/08 215/243

FOREIGN PATENT DOCUMENTS

WO 2008048039 A1 4/2008
WO WO-2019141973 A1 * 7/2019 ..... B67C 7/00
WO 2021245218 A1 12/2021

* cited by examiner

[Fig 1]
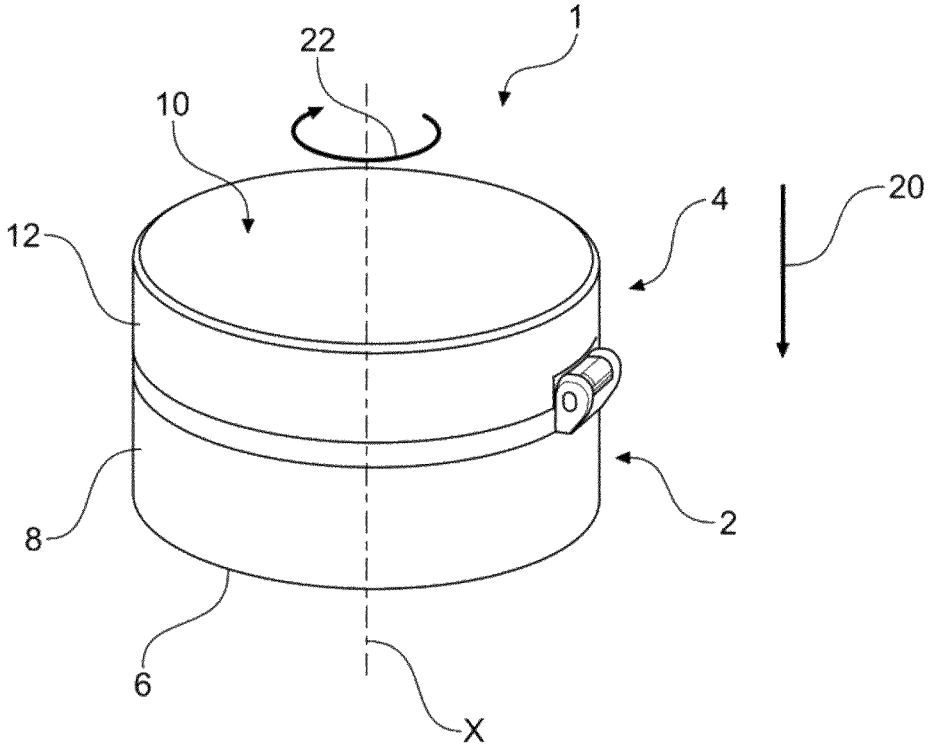
[Fig 2]
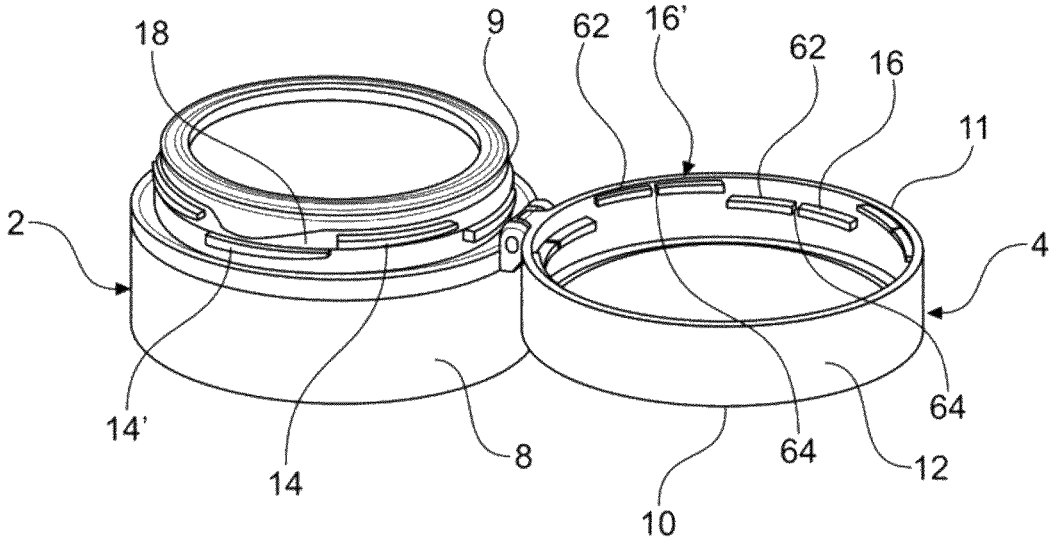

[Fig 3a]
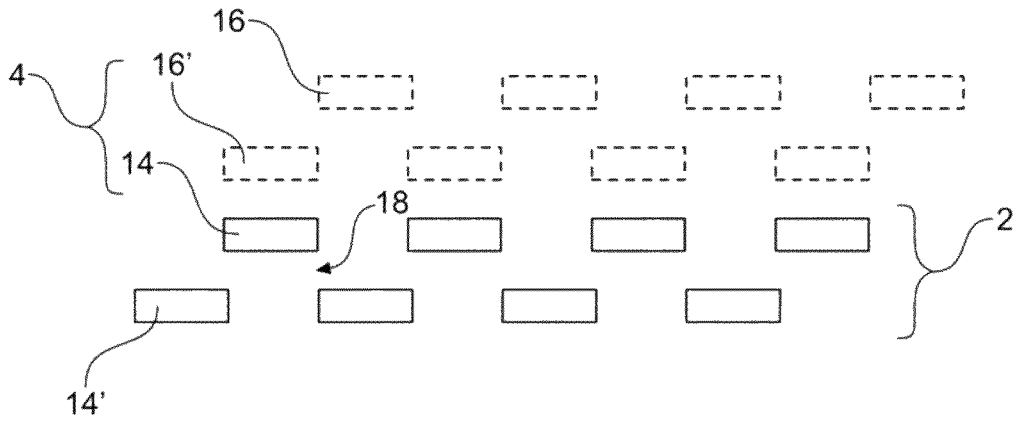
[Fig 3b]
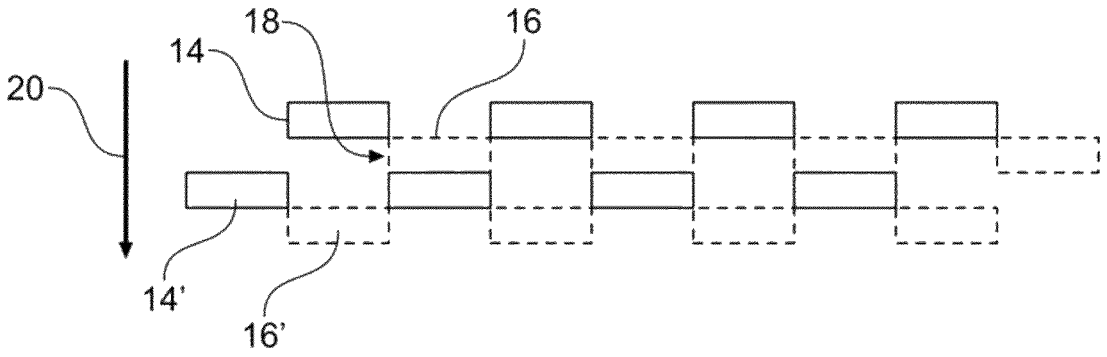

[Fig 3c]
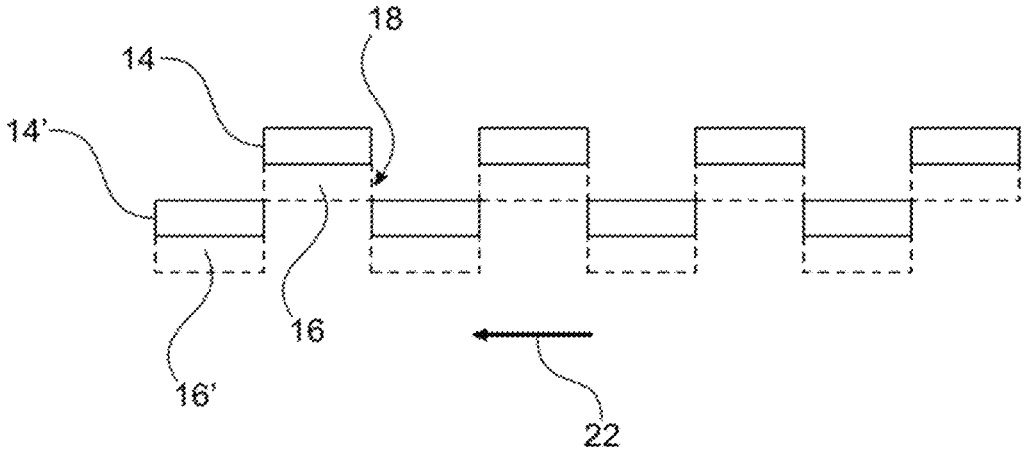
[Fig 4]
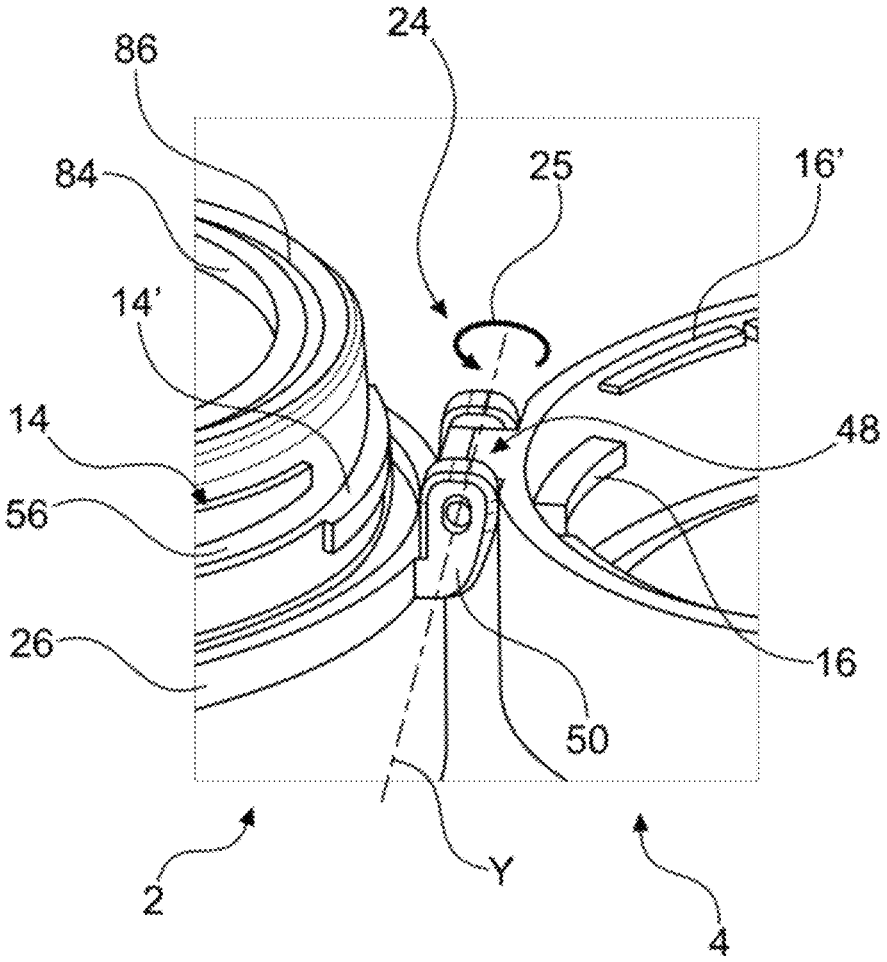

[Fig 5]
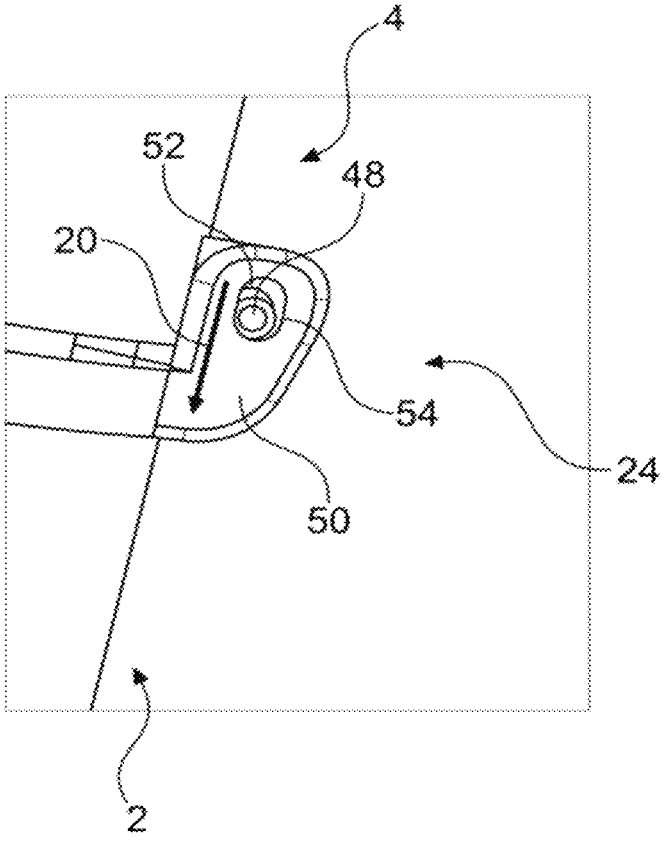

[Fig 6]
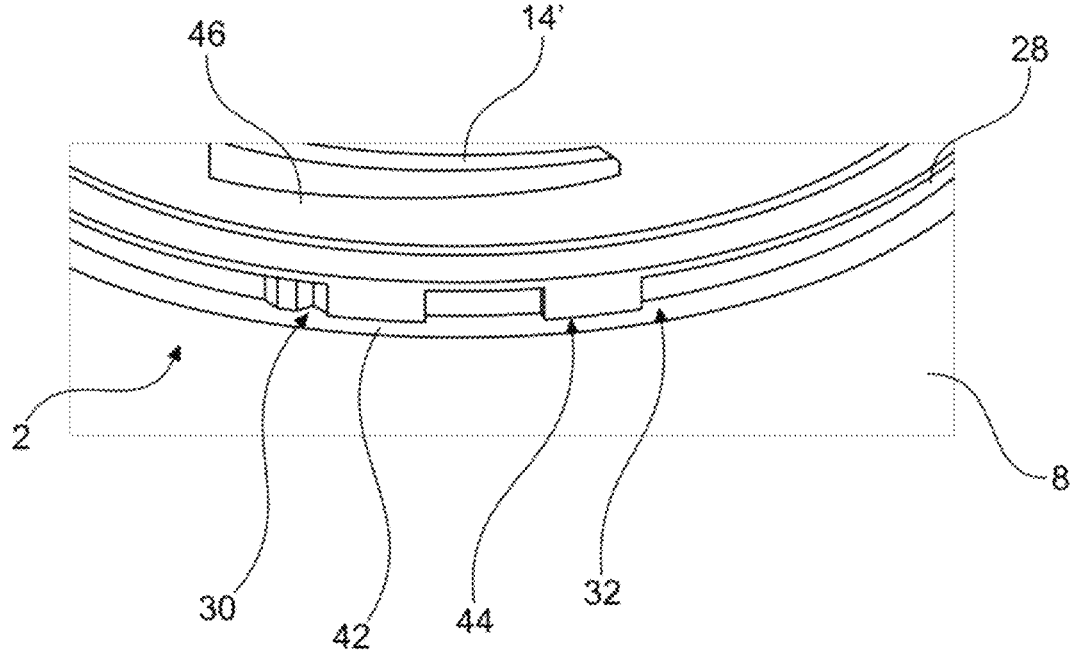
[Fig 7]
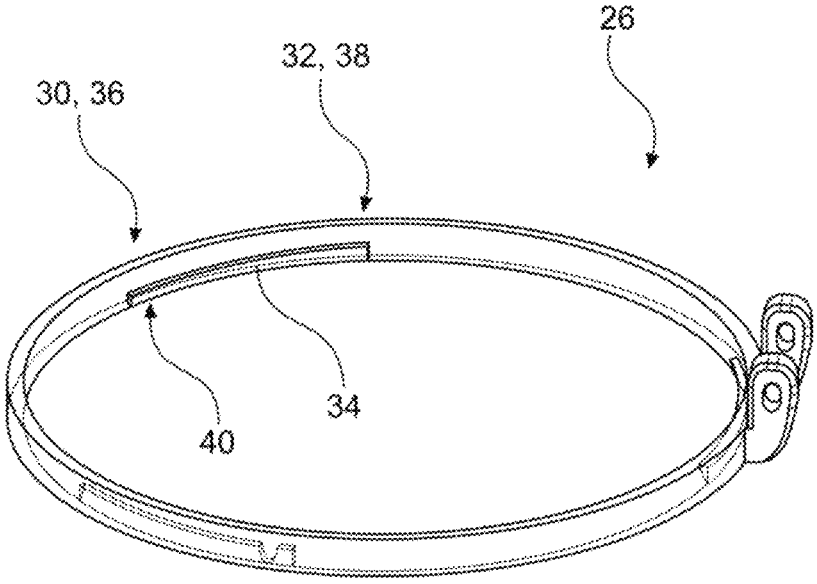

[Fig 8]
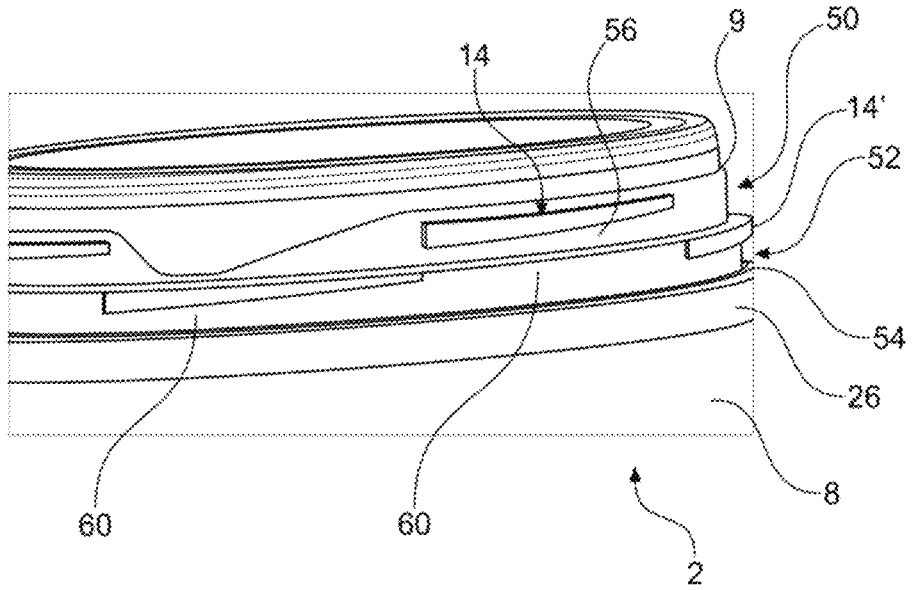
[Fig 9]
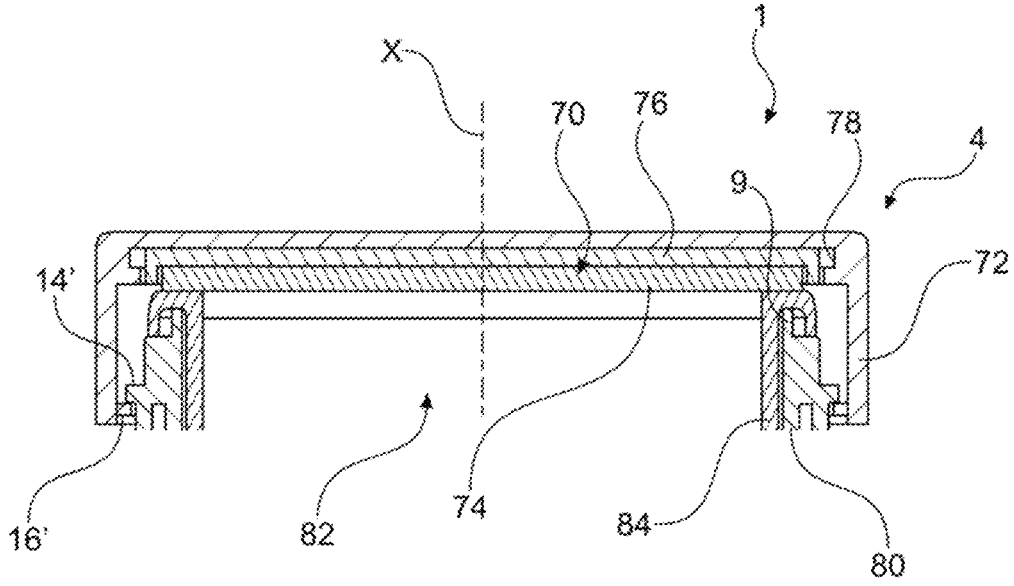

[Fig 10]
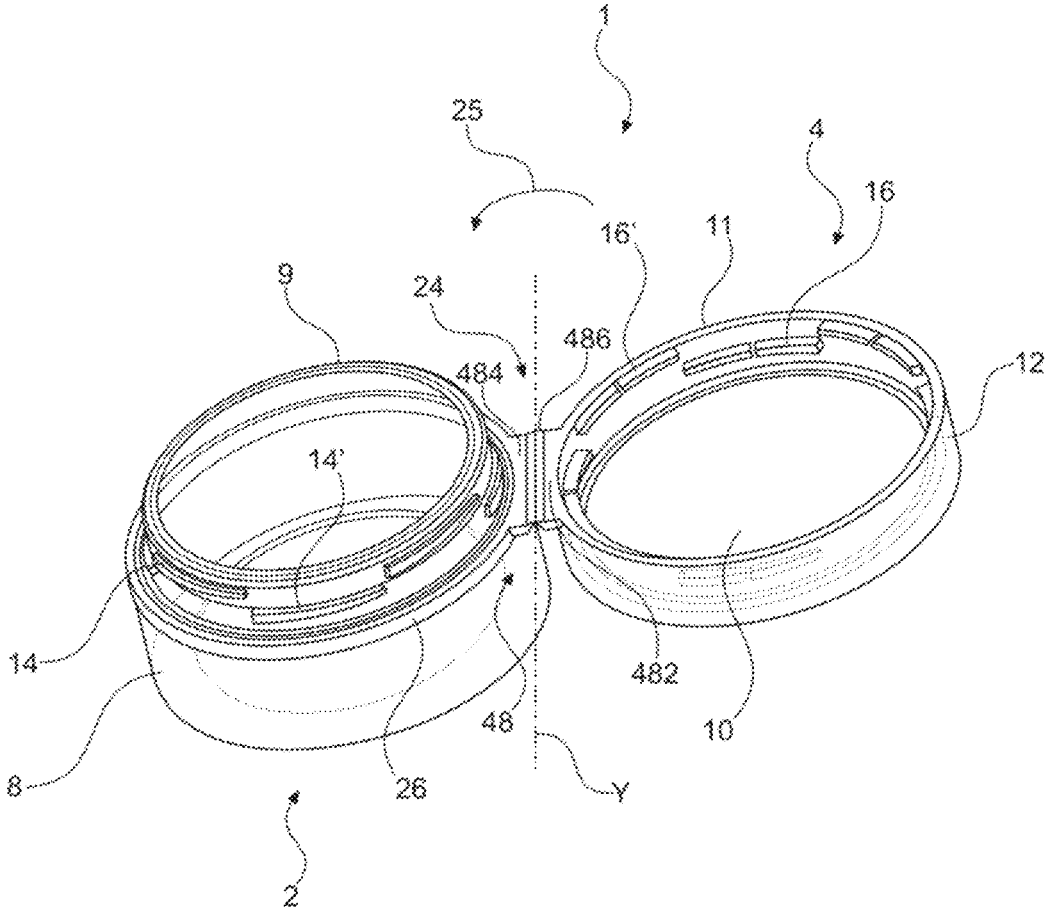

[Fig 11]
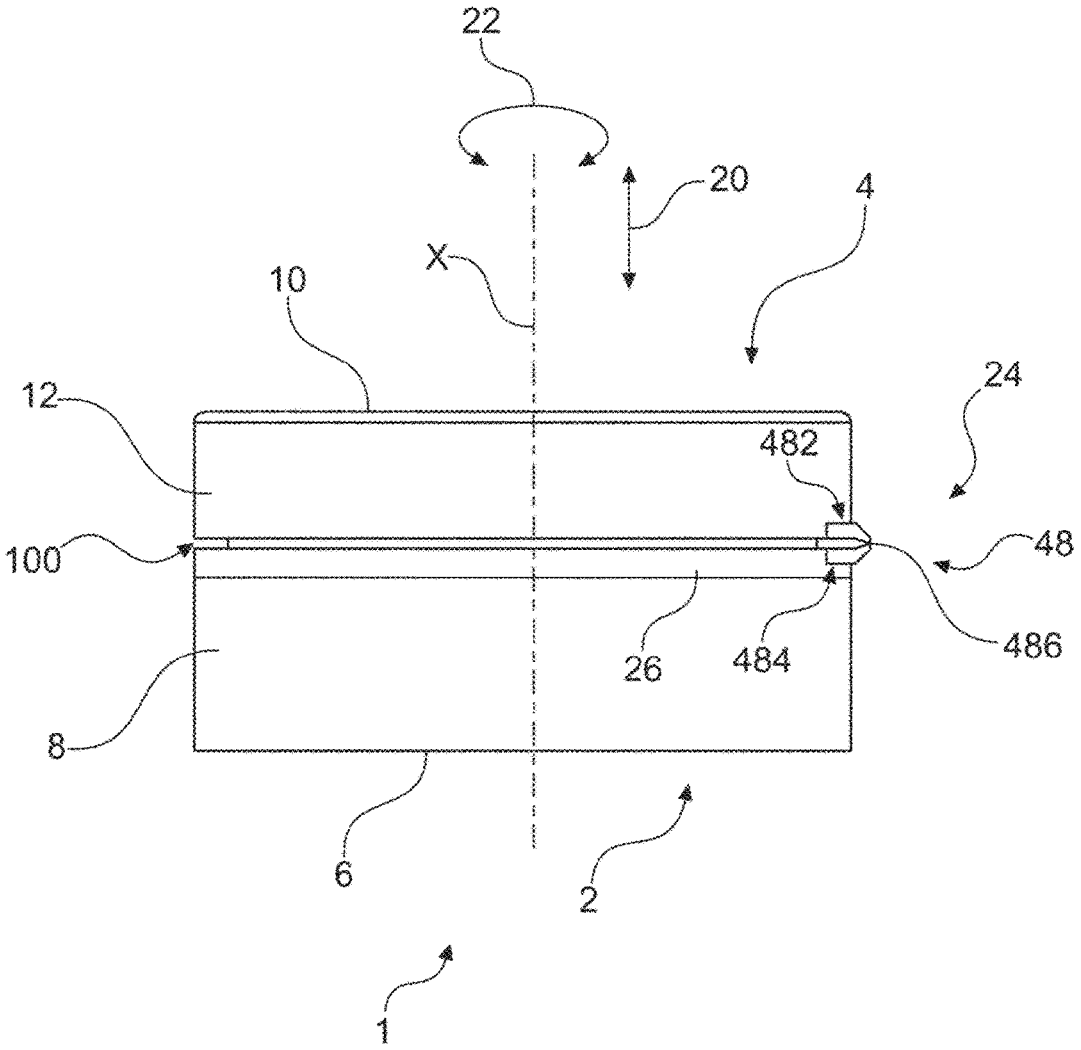

RECEPTACLE FOR PRODUCTS, IN PARTICULAR COSMETIC PRODUCTS

CROSS-REFERENCE TO RELATED APPLICATIONS

This application claims priority to French Application No. 2400508, filed Jan. 18, 2024, and to French Application No. 2307669, filed Jul. 18, 2023, the contents of both of which are incorporated herein by reference in their entireties.

The invention concerns a receptacle for a product, in particular a cosmetic product.

To close a receptacle comprising a pot and a cover, it is common practice to screw the cover onto the pot. In such a case, the cover is positioned on the pot in a high position, at a given angular location corresponding to that where the threads of the cover engage with the threads of the pot, and the user then screws it down to a low position of the cover corresponding to a closed position of the receptacle. One disadvantage of this solution is that the effort required is sometimes too great, particularly for people who have difficulty exerting a movement of screwing or unscrewing.

Bayonet-type closing movements are also known, wherein an axial movement is followed by a rotation. At the end of this movement, shapes of the cover are in contact with shapes of the pot to keep the cover closed. However, the area of contact between these shapes may not exceed a certain angular extent, otherwise the shapes used would conflict with each other during the closing movement. The contact area therefore remains limited. On the other hand, the angular amplitude to reach the closed position of the receptacle is relatively large.

While a limited-quality closure may be sufficient for powder cosmetic products, it is not satisfactory for more fragile products such as cosmetic products in the form of cream or liquid.

The purpose of the invention is to overcome at least some of the above disadvantages and to this end proposes a receptacle for a product, in particular a cosmetic product, said receptacle having an axis, referred to as longitudinal axis and comprising a pot and a cover of said pot, said pot having first radial protrusions as well as second radial protrusions, that are at least axially offset relative to the first protrusions of the pot, said cover having first radial protrusions and second radial protrusions that are at least axially offset relative to the second protrusions of the cover, said first protrusions of the pot and/or of the cover extending over a first portion of a circumference of said receptacle, said second protrusion of the pot and/or of the cover extending over a second portion of a circumference of said receptacle, said first and second protrusions being configured to cooperate with each other so as to obtain first and second contact areas respectively, on the one hand, between the first protrusions of the pot and the first protrusions of the cover and, on the other hand, between the second protrusions of the pot and the second protrusions of the cover in a closed position of said receptacle.

Thus, in the closed position, the first protrusions form a first row of protrusions located substantially at the same first level along the longitudinal axis of the receptacle, on the one hand, on the pot and, on the other hand, on the cover. Similarly, the second protrusions form a second row of protrusions located substantially at the same second level along the longitudinal axis of the receptacle, on the one hand, on the pot and, on the other hand, on the cover.

The axial offset between the protrusions of the first row and those of the second row is configured so that the protrusions of one row angularly complement those of the other row, creating a space for the protrusions of one row of the cover between two rows of the protrusions of the pot.

In this way, even if the protrusions of the same row are angularly discontinuous, the angular span of the contact areas between the protrusions of the first row combine with that of the contact areas between the protrusions of the second row, to form an overall contact area without causing areas of conflict between the protrusions.

According to a first preferred aspect of the invention, said first and second contact areas extend cumulatively over more than 180°, or even over more than 270°, said receptacle comprising a seal, said seal being configured to be compressed between said pot and said cover at least in said closed position.

This provides an improved sealing, without the need for screwing, or at least without the need for screwing over the entire stroke of the cover along the longitudinal axis of the receptacle. As the contact areas extend over a large proportion of the periphery of the receptacle, the seal is compressed more homogeneously.

According to another preferential aspect of the invention, which may or may not be combined with the previous one, said first and second protrusions are configured so as to engage respectively against each other to close the receptacle according to a movement referred to as a bayonet movement, comprising at least one rotation about said longitudinal axis, said rotation being less than a cumulative angular amplitude of a first and of a second of said protrusions adjacent to the pot and/or than a cumulative angular amplitude of a first and of a second of said protrusions adjacent to the cover.

This means that the cover may be closed with a rotational movement of the cover having a limited angular amplitude.

According to various additional characteristics of the invention, which may be taken together or separately and which form as many embodiments of the invention:

- said bayonet movement further comprises an axial translation of said cover with respect to said pot to bring the first protrusions of the cover into axial correspondence with the first protrusions of the pot and the second protrusions of the cover into axial correspondence with the second protrusions of the pot, said translation being followed by at least said rotation,
- a free edge of the first protrusions of the pot is radially set back from a free edge of the second protrusions of the pot to allow said second protrusions of the cover to pass in front of said first protrusions of the pot when said receptacle is opened and/or closed, in particular during said translation, and a free edge of the first protrusions of the cover is radially in front of a free edge of the second protrusions of the cover to allow said first contact areas to be formed between said first protrusions of the pot and said first protrusions of the cover,
- the first protrusions of the cover and the first protrusions of the pot have substantially the same angular span,
- the second protrusions of the cover and the second protrusions of the pot have substantially the same angular span,
- the first protrusions of the pot are four in number, the second protrusions of the pot are four in number, the first protrusions of the cover are four in number and the second protrusions of the cover are four in number, said first and second protrusions of the pot and of the cover having an angular span of approximately 45°, a height of said first and/or second protrusions is substantially identical to the axial offset between said first and second protrusions;

an angular span of said first and/or second protrusions is substantially identical to an angular stroke of said cover, an angle of said rotation about the longitudinal axis is between 3° and 60°, in particular about 45°, said first and second portions of the circumference are complementary to each other so as to extend over substantially the whole of said circumference, said receptacle comprises an articulation of the cover on the pot, allowing the cover to be held securely to the pot, said articulation comprises a ring which is movable in rotation on the pot about said longitudinal axis and/or a hinge, allowing the cover to be mobile in rotation about an articulation axis and/or in translation along said longitudinal axis, said receptacle is configured to have a longitudinal clearance between the cover and the ring in the closed position, said articulation is configured so that, when the pot is closed, the bayonet movement is preceded by a rotation of the cover about said articulation axis, said articulation axis is orthogonal to said longitudinal axis, the rotation of said cover about the articulation axis is approximately 180°, said articulation axis may move in translation along said longitudinal axis, at least during the bayonet movement, said articulation axis is movable in rotation about said longitudinal axis, relative to the pot, at least during the bayonet movement, said pot comprises a gorge inside which said ring is housed, said gorge and said ring mutually define one or more angular abutments to the rotation of the ring about said longitudinal axis, a first of the angular abutments corresponds to a position of displacement of the cover about the articulation axis and/or to a position at the start-of-stroke of the bayonet movement, a second of the angular abutments corresponds to an end-of-stroke position of the bayonet movement, said first and/or said second abutment comprise a notch for snapping the ring onto the pot, said hinge is movable in translation along said longitudinal axis, said hinge is movable in rotation about said articulation axis, said articulation further comprises a bearing within which said hinge is articulated, said bearing has an oblong orifice inside which nipples of said hinge are movable in rotation about said articulation axis and/or in translation along said longitudinal axis, said hinge is connected to said cover and/or said bearing is connected to said ring, said hinge is connected to said ring and to said cover, in particular is in one piece with said ring and said cover, said hinge is elastically deformable, said hinge is a film hinge, said pot has a stepped configuration with a first stage and a second stage, said first stage extending from an upper edge of said pot to the second stage, the first stage having a radial extension less than that of the second stage, said first protrusions of the pot are located at the level of the first stage, said second protrusions of the pot are located at the level of the second stage, said first and second protrusions of the pot have a substantially identical radial extension from a lateral flank of the pot, said first protrusions of the cover have a greater radial extension than the second extensions of the cover, said first extensions of the pot and of the cover are formed with complementary patterns, said second extensions of the pot and of the cover are formed with complementary patterns said complementary patterns have faces facing each other in the form of ramps, said ramps are configured to engage against each other, thanks to a profile of said ramps, during an angular stroke described by the cover, in particular at mid-stroke, said first and/or second protrusions of the pot and/or of the cover are interrupted by a radial slot, said radial slot is located angularly at approximately mid-stroke, said seal is annular, said cover houses said seal, leaving said seal free to rotate, in particular about said longitudinal axis, said cover comprises a cover cap housing said seal, said first and second protrusions of said cover originate from said cap, said seal comprises a disc of compressible material and a rigid support for said disc, said support is free to rotate in said cap about said longitudinal axis at least during said bayonet movement, said support is snapped onto said cap, said pot comprises a case defining a housing;

said receptacle comprises a removable capsule located in said housing, said capsule being configured to accommodate said product, said capsule has a lip configured to compress said seal when the cover is closed, said first and/or second protrusions of the pot originate from said case.

The invention will be better understood, and other purposes, details, characteristics and advantages thereof will become clearer in the course of the detailed explanatory description which follows, of at least one embodiment of the invention given by way of purely illustrative and non-limiting example, with reference to the appended schematic drawings among which:

FIG. 1 schematically illustrates in perspective a first example of a receptacle according to the invention in the closed position;

FIG. 2 shows a schematic perspective view of the receptacle shown in FIG. 1 in the open position, before a cover on the receptacle is folded back over a pot of said receptacle;

FIGS. 3*a*-3*c* schematically illustrate, spread out flat, the protrusions of said receptacle as seen in FIG. 3*a* after the cover has been folded back onto the pot, in FIG. 3*b* in an intermediate position, and in FIG. 3*c* in the closed position of the receptacle;

FIG. 4 schematically illustrates a detail of FIG. 2;

FIG. 5 shows the same detail as FIG. 5 but in a position close to the closed position of the receptacle;

FIG. 6 schematically illustrates, in perspective, a partial view of the pot of the receptacle of the preceding figures, in a portion configured to receive a ring of the receptacle;

FIG. 7 shows a schematic perspective of the ring described above in relation to FIG. 6;

FIG. 8 shows a schematic perspective view of an area of the pot of the receptacle of FIGS. 1 and 2 from a side view angle;

FIG. 9 schematically illustrates a top portion of the receptacle of FIGS. 1 and 2, in the closed position, in a longitudinal cross-section;

FIG. 10 schematically illustrates in perspective a second example of a receptacle according to the invention in the open position;

FIG. 11 shows a schematic side view of the receptacle of FIG. 10 in the closed position of its cover on its pot.

As illustrated in FIGS. 1 and 2 as well as FIGS. 10 and 11, the invention relates to a receptacle 1 for a product, in particular a cosmetic product. For example, a powder, semi-liquid or liquid product such as a foundation, a cream, a lotion or other product.

Said receptacle has an axis X referred to as longitudinal axis. It comprises a pot 2 and a cover 4 for said pot 2. Said pot 2 has here a substantially cylindrical shape with a bottom 6 and a lateral wall 8 extending from said bottom 6 along said longitudinal axis X. Said cover 4 has an upper wall 10 and a lateral skirt 12 extending from said upper wall 10 to co-operate with the lateral wall 8 of the pot 2. Said skirt 10 extends along the longitudinal axis X, at least in a closed position of the receptacle, as in FIGS. 1 and 11.

To open and/or close the receptacle 1, as may be seen more clearly in FIG. 2 or FIG. 10 where the receptacle is open, said pot 2 and said cover 4 have first radial protrusions 14, 16 extending angularly over a first portion of a circumference of said receptacle, as well as second radial protrusions 14', 16', offset at least axially with respect to the first protrusions 14, 16 and extending over a second portion of said circumference. In other words, the first protrusions 14, 16 form a first row of protrusions substantially located, in the closed position, at the same first level along the longitudinal axis X of the receptacle, on the one hand, on the pot 2 for the protrusions marked 14 and, on the other hand, of the cover 4 for the protrusions marked 16. Similarly, the second protrusions 14', 16' form a second row of protrusions substantially located, in the closed position, at the same second level along the longitudinal axis X of the receptacle, on the one hand, on the pot 2 for the protrusions marked 14' and, on the other hand, on the cover 4 for the protrusions marked 16'. Alternatively, the receptacle comprises three or more rows of protrusions, each row being axially offset from one another and the protrusions of the different rows covering respective angular segments. The assembly of said protrusions 14, 14' of the pot 2 extend radially towards the outside of the pot 2 and the assembly of the protrusions 16, 16' of the cover 4 extend radially towards the inside of the cover 4.

The first row of protrusions 14 of the pot 2 is located close to a free edge 9 of the lateral wall 8 of the pot 2 and the second row of protrusions 14' of the pot 2 is located below. The second row of protrusions 16' of the cover 4 is located close to a free lateral edge 11 of the lateral skirt 12 of the cover 4 and the first row of protrusions 16 of said cover 4 is located between said first row of protrusions 16' of the cover 4 and the upper wall 10 of said cover 4.

The radial offset between the protrusions 14, 16 of the first row and those 14', 16' of the second row is configured to ensure that the protrusions of the cover 4 of one of the rows, in this case the protrusions 16', do not abut against the protrusions of the pot 2 of the other row, in this case the protrusions 14, when the cover 4 is inserted onto the pot 2 in a movement along the longitudinal axis X of the receptacle.

The axial offset between the protrusions 14, 16 of the first row and those 14', 16' of the second row is configured so that the protrusions of one of the rows angularly complement those of the other row by providing a passage 18 for the protrusions of one of the rows of the cover 4, in this case the protrusions 16, between the two rows of the protrusions 14, 14' of the pot 2 when the cover 4 is rotated relative to the pot 2 about the longitudinal axis X of the receptacle.

Said first and second protrusions 14, 16 and 14', 16' are configured to cooperate with each other respectively so as to obtain contact areas.

In other words, said first protrusions 14 of the pot 2 and said first protrusions 16 of the cover 4 are configured to engage respectively against each other to close the receptacle. Said second protrusions 14' of the pot 2 and said second protrusions 16' of the cover 4 are also configured to engage against each other to close the receptacle.

Said contact areas are distributed over the whole of said circumference, said contact areas extending angularly over at least 270° in the closed position of said receptacle. In other words, if the angular span of the areas in which said first protrusions 14 of the pot 2 are in contact with said first protrusions 16 of the cover 4 and that of the areas in which said second protrusions 14' of the pot 2 and said second protrusions 16' of the cover 4 are in contact are added together, in the closed position of the receptacle, the total angular span of these contact areas reaches and/or exceeds 270°.

With such an angular span, made possible by the distribution of the protrusions in at least two rows, the contact area in accordance with the invention provides an improved sealing without having to resort, or only partially, to screwing.

As may be seen more clearly in views 3*a* to 3*c*, preferably said first and second protrusions 14, 16, 14', 16' are configured to engage respectively against each other to close the receptacle in a movement referred to as bayonet movement comprising an axial translation of said cover 4, according to the arrow marked 20, relative to said pot 2 followed by a rotation about said longitudinal axis X, according to the arrow marked 22. In other words, with the two rows of protrusions, the receptacle conforming to the invention comprises a double bayonet closure system.

In view 3*a*, the cover 4 is in a high position relative to the pot 2 and its protrusions 16, 16' are all above the protrusions 14, 14' of the pot 2. In view 3*b*, the cover 4 is in a low position relative to the pot 2 and its first-row protrusions 16 are below the axial level of the first-row protrusions 14 of the pot 2, while the second-row protrusions 16' of the cover 2 are below the axial level of the second-row protrusions 14 of the pot 2. To achieve this, the protrusions 16' on the second row of the cover 4 are moved in front of the protrusions 14 on the first row of the pot, by the radial set back of the latter. Still in view 3*b*, the protrusions 14, 16 and 14', 16' of the same row are angularly offset from each other. More precisely, they are staggered or, in other words, in phase opposition. In view 3*c*, after rotation, they are now facing each other or, in other words, in phase.

Advantageously, the first protrusions 16 of the cover 4 and the first protrusions 14 of the pot 2 have approximately the same angular span. Cumulatively or alternatively, the second protrusions 16' of the cover 4 and the second protrusions 14' of the pot 2 have approximately the same angular span. Again cumulatively or alternatively, said first and second portions of the circumference are complementary to each other over substantially the whole of said circumference. In the illustrated embodiment, all these characteristics are combined and, in the closed position, an angular positioning of each of the first protrusions 14, 16 correspond to each other to form a contact area over their entire angular span. The same applies to the second protrusions 14', 16'. In addition, the contact areas formed in this way follow one another in angular succession over almost the entire circumference of the receptacle, with the axial offset between the first and second rows close at hand.

More specifically, the first protrusions 14 of the pot 2 are four in number, the second protrusions 14' of the pot 2 are four in number, the first protrusions 16 of the cover 4 are four in number and the second protrusions of the cover 4 are four in number, said first and second protrusions 14, 14', 16, 16' of the pot 2 and of the cover 4 having an angular span of approximately 45°. This is just one example allowing to have a total amplitude of contact areas of 360° and another number n of protrusions is possible, the angular amplitude of the protrusions then being 360°/n. Alternatively, and not illustrated, the first and/or the second protrusions 14, 14' of the pot 2 or the first and/or second protrusions 16, 16' of the cover 4 are formed by pins which make a tangential contact with the corresponding protrusions.

Advantageously, a height of said protrusions, more particularly of said second protrusions 16' of the cover 2, is substantially identical to the axial offset between said first and second protrusions 14, 16, 14', 16'. The aforementioned second protrusions 16' of the cover 2 thus at least partially obstruct the aforementioned passage 18, even when the receptacle is in the closed position.

Again advantageously, an angular span of said first and/or second protrusions 14, 16, 14', 16' is substantially identical to an angular span of said rotation about the longitudinal axis X. This allows to ensure that the protrusions of the cover 4 are opposite the protrusions of the pot 2 in the closed position.

By way of example, an angle of said rotation about the longitudinal axis X is between 30° and 60°, in particular approximately 45°. In the embodiment shown, each row comprises eight protrusions, giving a total angular amplitude of almost 360° when the angular span of the protrusions 14, 16, 14', 16' of the two rows is added together.

As illustrated in FIGS. 4 and 5 and FIGS. 10 and 11, to facilitate handling of the cover 4, said receptacle comprises an articulation 24 for the cover 4 on the pot 2 allowing to hold the cover 4 securely to the pot 2. Said articulation 24 is configured so that, when the receptacle is closed, the bayonet movement is preceded by a rotation of the cover 4 about an articulation axis Y, according to the arrow marked 25. Said articulation axis is orthogonal to said longitudinal axis X. The rotation of said cover 2 about the articulation axis Y is, for example, approximately 180°.

To allow said bayonet movement, said articulation 24 and with it said articulation axis Y are movable in translation along said longitudinal axis X and in rotation about said longitudinal axis X, relative to the pot 2. To this end, said articulation 24 comprises a ring 26 that is movable in rotation on the pot 2 about said longitudinal axis X.

As illustrated in FIG. 6, said pot 2 comprises a gorge 28 inside which said ring 26 is housed. In FIG. 6, the ring 26 has not been illustrated in order to see the detail of the gorge 28. Said gorge 28 is formed under the second row of protrusions 14' of the pot 2. It allows the degree of rotational freedom of the ring 26 mentioned above.

Referring also to FIG. 7, it may be seen that said gorge 28 and said ring 26 mutually define one or more angular abutments 30, 32 to the rotation of the ring about said longitudinal axis X. More specifically, a first 30 of the angular abutments corresponds to a position of displacement of the cover about the articulation axis Y and/or to a position at the start-of-stroke of the bayonet movement. A second 32 of the angular abutments corresponds to an end-of-stroke position of the bayonet movement and therefore to the closed position of the receptacle. This contributes to the correct positioning of the cap with the base, and therefore to the correct alignment of the first and second protrusions 14, 16, 14', 16', particularly for sealing at the end-of-stroke.

Said ring 26 comprises at least one angular groove 34 projecting radially inwards from an annular portion of said ring 26. Said groove 34 has opposite angular ends 36, 38 and a possible recess 40, located here close to a first 36 of said angular ends. Said gorge 28 comprises counter-forms 42, 44 and a possible snap-in pin 46. Said counter-forms 42, 44 and said pin 46 project radially outwards from a bottom of said gorge 28. Said snap-in pin 46 is located close to a first 42 of said counter-forms.

Said first 30 of the angular abutments of the ring 26 in the gorge 28 is formed, for example, by the first 36 of the angular ends of the groove 34, said first 36 of the angular ends of the groove 34 being configured to come to bear against the first 42 of the counter-forms in the position in question. In the latter position, said pin 46 is advantageously snapped into the recess 40. In other words, said first abutment comprises a notch for snapping the ring 26 onto the pot 2.

The second 32 of the angular abutments for the ring 26 in the gorge 28 is formed, for example, by the second 38 of the angular ends of the groove 34, said second 38 of the angular ends of the groove 34 being configured to come to bear against the second 44 of the counter-forms. Said first and second counter-forms 42, 44 are spaced apart. Alternatively, they are angularly continuous with each other and form one and the same counter-form and the abutments 30, 32 are formed, on the ring 26 side, by the opposite angular ends of said same counter-form.

To move from the open position shown in FIGS. 2 and 10 to the closed position shown in FIGS. 1 and 11, as will be seen, the user first folds back the cover 4 onto the pot 2 by rotating it through 180° about the articulation axis Y according to the arrow 25. During this movement, the ring 26 is in abutment in the gorge 28 with snap-fit. Once the cover 4 has been folded back onto the pot 2, it has already completed the translation portion of the bayonet movement along the longitudinal axis X and the protrusions 16, 16' of the cover 4 are axially below the protrusions 14, 14' of the pot, for each of the rows of protrusions, as shown in view 3*b*. The cover 2 is then rotated about the longitudinal axis X according to the arrow 22 until the ring 26 reaches the end-of-stroke. This end-of-stroke is marked by the second abutment 32. The receptacle is then in its closed position, the protrusions 14, 14', 16, 16' of the pot 2 and of the cover 4 being in register with each other in their respective rows, as shown in view 3*c*. To open the receptacle, the reverse movement is used.

Referring again to FIGS. 4, 5, 10 and 11, it may be seen that said articulation 24 comprises a hinge 48, allowing the cover 4 to be movable in rotation about the articulation axis Y and/or in translation along said longitudinal axis X, following the arrow 20.

In the embodiment shown in FIGS. 4 and 5, said hinge 48 is itself movable in rotation about said articulation axis Y and/or in translation along said longitudinal axis X. In addition, said articulation 24 comprises a bearing 50 inside which said hinge 48 is articulated. Said bearing 50 has an oblong orifice 52 inside which nipples 54 of said hinge 48 are movable in rotation about said articulation axis Y and/or in translation along said longitudinal axis X. Said hinge 48 is connected to said cover 4, in particular is in one piece with said cover 4. Said bearing 50 is connected to said ring 26, and in particular is in one piece with said ring 26.

As may be seen in FIG. 8, said pot 2 has a stepped configuration with a first stage 50 and a second stage 52. Said first stage 50 extends axially from the upper edge 9 of said pot 2 to the second stage 52. The second stage 52 extends axially from the first stage 50 to an upper edge 54 of the gorge accommodating the seal 26. The first stage 50 has a smaller radial extension than the second stage, due in particular to a reduction in the thickness of the lateral wall 8 of the pot 2. Alternatively, not illustrated, cumulatively or alternatively, said cover has such a stepped configuration.

Said first protrusions 14 of the pot 2 are located at the level of the first stage 50. Said second protrusions 14' of the pot 2 are located at the level of said second stage 52. Said first and second protrusions 14, 14' of the pot 2 have a substantially identical radial extension from a lateral flank of the pot so that said first protrusions 14 of the pot 2 have a distal edge 56 which is radially offset, set back, with respect to the lateral flank of the pot 2 at the level of said second stage 52 and therefore with respect to said second protrusions 14' of the pot 2 (this may also be seen in FIG. 4).

Said first protrusions 16 of the cover 4 have a greater radial extension than the second extensions 16' of the cover 4. Such a radial extension, combined with the radial set back of the first extensions 14 of the pot 2, allows the second protrusions 16' of the cover 4 to pass in front of the first protrusions 14 of the pot 2 during the translation of the cover 4 along the longitudinal axis X, as mentioned above, while allowing the first protrusions 16 of the cover 4 to engage with said first extensions 14 of the pot 2 during the rotation of the cover 4 about the longitudinal axis X, despite the radial set back of said first extensions 14 of the pot 2.

Advantageously, said first extensions 14, 16 of the pot 2 and of the cover 4 are formed in complementary patterns. The same applies to the second extensions 14', 16'. Said complementary patterns have opposite faces in the form of ramps 60, 62, in particular substantially helical ramps. Said ramps 60, 62 are configured to engage one against the other, thanks to a profile of said ramps, during the angular stroke described by the cover 2 during its rotation about said longitudinal axis X, particularly at mid-stroke. In other words, according to this example, a first half of the angular stroke of the cover 4 is free, without the protrusions engaging against each other. During the second half of the stroke, the protrusions are engaged one against the other to reach the end-of-stroke position. These ramps have an inflection point. In other words, a slope of said ramps is steeper downstream of said inflection point than upstream, in the direction of rotation. Note that this is not possible with conventional screwing. In the illustrated embodiment, this means that the rotation phase of the bayonet movement has a slight screwing component due to the inclination of the ramps 60, 62, during the second portion of the angular stroke of the cover about the longitudinal axis X. However, this component is smaller, even much smaller than the component resulting from the previous phase of translation of the cover 2 along said longitudinal axis X. This difference may be seen in FIG. 5, where the cover 4 is not yet resting against the ring 26. In this figure, the translation phase along the axis X is complete and the cover 4 will come to rest against the ring 26 as a result of the additional descent of the cover 4 generated by the inclination of said ramps 60, 62. The faces of the protrusions 14, 14', 16, 16' opposite those in the form of a ramp are, for example, perpendicular to said longitudinal axis X.

Said protrusions 16, 16' of the cover 4 are interrupted by a radial slot 64. Said radial slot 64 is angularly located, for example, at approximately mid-stroke. On the cover 4 side, said slot 64 advantageously forms the inflection point mentioned above.

As illustrated in FIG. 9, said receptacle 1 advantageously has a seal 70 configured to be compressed during the closing movement. Said seal 70 is preferably configured so as to be compressed during the second portion of the rotation of the cover 4 about the longitudinal axis X. In other words, the ramps 60, 62 of the protrusions serve to compress said seal 70, in particular during the second portion of the rotation of the cover 4 about the longitudinal axis X. Said cover 4 comprises a cap 72 which accommodates said seal 70, preferably leaving said seal 70 free to rotate about said longitudinal axis X, at least during said bayonet movement.

Said first and second protrusions 16, 16' of said cover 4 originate from said cap 72. Said hinge 48 also comes from said cap 72.

The seal 70 comprises, for example, a disc 74 made of compressible material and a rigid support 76. Said disc 74 is connected to said support 76. Said support 76 is free to rotate in said cap 72 about said longitudinal axis X, at least during said bayonet movement. Said support 76 is, for example, snapped onto said cap 72, in particular into a gorge 78 in said cap 72. Said pot 2 comprises a case 80 defining a housing 82 and the receptacle 1 comprises a removable capsule 84, located in said housing 82. Said capsule 84 is configured to accommodate said product. Said capsule 84 has a lip 86 (visible in FIG. 2) configured to compress said seal 70 when the cover 4 is closed. Said first and/or second protrusions 14, 14' of the pot 2 come from said case 80.

Referring again to FIGS. 1 and 5 as well as FIGS. 10 and 11, it may be seen that the external diameters of said pot 2, said cover 4 and/or said ring 26 are substantially identical.

Alternatively or cumulatively, the cover 4 is in axial abutment against the ring 26 and/or the ring 26 is in axial abutment against the pot 2, in the closed position. These characteristics help to give the receptacle a uniform appearance when closed.

Alternatively, the receptacle is configured to have a longitudinal clearance 100, visible in FIG. 11, between the cover 4 and the ring 26 in the closed position. This allows to promote the compression of the seal 70 and therefore the sealing of said receptacle by preventing the cover 4 from abutting the ring 26 before compression of said seal 70. Such a longitudinal clearance 100 is achieved, for example, by means of the angular abutments mentioned above. If there is no ring 26, such a result is also obtained, advantageously, by creating said longitudinal clearance 100 between the cover 4 and the pot 2, in particular an annular shoulder on the pot 2.

According to the embodiments 10 and 11, said receptacle is preferably identical to the above except for the hinge 48. In fact, the latter is linked both to said ring 26, in particular is in one piece with said ring, and to said cover 4, in particular is in one piece with said cover. Said hinge 48 is also elastically deformable. To do this, it comprises first and second flaps 482, 484 connected by a thinning of material 486 forming a fold line of said hinge 48. The first flap 482 is connected to the cover 4 and/or the second flap 484 is connected to the ring 26. Said folding line 486 is oriented substantially tangentially to said pot 2 and/or to said cover 4. In other words, said hinge 48 is, for example, a film hinge.

Said hinge 48 is configured so that, in the open position, as illustrated in FIG. 10, said first and second flaps 482, 484 are substantially in the same plane on either side of said thinning 486

Said hinge 48 is configured so that, in the closed position, as illustrated in FIG. 11, said first and second flaps 482, 484 are on the same side of said thinning 486 forming at least locally an angle between them with said thinning 486 as a top. Said first and/or second flaps 482, 484 comprise a V-shaped configuration with a first branch linked to the thinning 486 and a second branch linked to the cover 4 and the ring 26 respectively. Said first branches of each of said first and second flaps 482, 484 are here parallel to each other. Said second branches of each of said first and second flaps 482, 484 have between them said angle having the thinning 486 as its top. Such a configuration has the advantage of allowing or at least facilitating the creation of the functional clearance 100 mentioned above.

In accordance with this embodiment, it is understood that the assembly formed by the cover 4, the ring 26 and the hinge 48 is preferably made in one-part. The result is a more functional 48 hinge that opens and closes in a simpler position. This also allows to arrange a thinner hinge 48, making the receptacle more aesthetically pleasing. The industrial integration of said articulation 24 is also simplified by the reduction in the number of parts and their relative adjustment in position.

It should also be noted that, particularly in the absence of a ring, the receptacle is advantageously equipped with an end-of-stroke catch, in particular formed by corresponding shapes on the pot 2 and/or the cover 4, one of the shapes being located, for example, on a free edge of the pot 2 to cooperate with a shape on the bottom of the cover 4, or alternatively, on an upper face of the first and second protrusions 14, 14' of the pot 2, or at least one of them, to cooperate with the corresponding slot or slots 64 of the first and second protrusions 16, 16' of the cover 4.

The invention claimed is:

1. A receptacle for a product, said receptacle having a longitudinal axis, and comprising a pot and a cover of said pot, said pot having first radial protrusions and second radial protrusions that are at least axially offset relative to said first protrusions of the pot, said cover having first radial protrusions and second radial protrusions that are at least axially offset relative to said second protrusions of the cover, said first protrusions of the pot and/or of the cover extending over a first portion of a circumference of said receptacle, said second protrusions of the pot and/or of the cover extending over a second portion of a circumference of said receptacle, said first and second protrusions being configured to cooperate with each other so as to obtain first and second contact areas respectively, on the one hand, between the first protrusions of the pot and the first protrusions of the cover and, on the other hand, between the second protrusions of the pot and the second protrusions of the cover in a closed position of said receptacle, wherein a free edge of the first protrusions of the pot is radially set back from a free edge of the second protrusions of the pot to allow said second protrusions of the cover to pass in front of said first protrusions of the pot when the receptacle is opened and/or closed, and a free edge of the first protrusions of the cover is radially in front of a free edge of the second protrusions of the cover to allow said first contact areas to be formed between said first protrusions of the pot and said first protrusions of the cover.

2. The receptacle according to claim 1, wherein said first and second contact areas extend cumulatively over more than 180°, said receptacle comprising a seal, said seal being configured to be compressed between said pot and said cover at least in said closed position.

3. The receptacle according to claim 2, wherein said cover accommodates said seal leaving said seal free to rotate.

4. The receptacle according to claim 1, wherein the first protrusions of the cover and the first protrusions of the pot have substantially the same angular span and/or the second protrusions of the cover and the second protrusions of the pot have substantially the same angular span.

5. The receptacle according to claim 1, wherein a height of said first and/or second protrusions is substantially identical to the axial offset between said first and second protrusions.

6. The receptacle according to claim 1, wherein an angular span of said first and/or second protrusions is substantially identical to an angular stroke of said cover.

7. The receptacle according to claim 1, wherein said first and second protrusions are configured so as to engage respectively against each other to close the receptacle according to a movement, referred to as a bayonet movement, comprising at least one rotation about said longitudinal axis.

8. The receptacle according to claim 7, wherein said bayonet movement further comprises an axial translation of said cover with respect to said pot to bring the first protrusions of the cover into axial correspondence with the first protrusions of the pot and the second protrusions of the cover into axial correspondence with the second protrusions of the pot, said translation being followed by at least said rotation.

9. The receptacle according to claim 7, wherein said rotation is less than a cumulative angular amplitude of a first and of a second of said protrusions adjacent to the pot and/or than a cumulative angular amplitude of a first and of a second of said protrusions adjacent to the cover.

10. The receptacle according to claim 9, wherein the first protrusions of the pot are four in number, the second protrusions of the pot are four in number, the first protrusions of the cover are four in number and the second protrusions of the cover are four in number, said first and second protrusions of the pot and of the cover have an angular span of approximately 45°, an angle of said rotation about the longitudinal axis being approximately 45°.

11. The receptacle according to claim 1, wherein said first and second portions of the circumference are complementary to each other so as to extend over substantially the whole of said circumference.

12. The receptacle according to claim 1, wherein said receptacle comprises an articulation of the cover on the pot allowing the cover to be held securely to the pot.

13. The receptacle according to claim 12, wherein said articulation comprises a ring which is movable in rotation on the pot about said longitudinal axis and/or a hinge, allowing the cover to be mobile in rotation about an articulation axis and/or in translation along said longitudinal axis.

14. The receptacle according to claim 13 configured to have a longitudinal clearance between the cover and the ring in the closed position.

15. The receptacle according to claim 13, wherein said hinge is connected to said ring and to said cover, in particular is in one piece with said ring and said cover, said hinge being elastically deformable.

16. The receptacle according to claim 13, wherein said hinge is a film hinge.

17. The receptacle according to claim 1, wherein said pot has a stepped configuration with to a first stage and a second stage, said first stage extending from an upper edge of said pot to the second stage, the first stage having a radial extension less than that of the second stage.

18. The receptacle according to claim 1, wherein said first extensions of the pot and of the cover are formed with complementary patterns and/or said second extensions of the pot and of the cover are formed with complementary patterns.

19. The receptacle according to claim 18, wherein said complementary patterns have faces facing each other in the form of ramps.

20. The receptacle according to claim 19, wherein said ramps are configured to engage against each other, thanks to a profile of said ramps.

21. The receptacle according to claim 1, wherein said first and/or second protrusions of the pot and/or of the cover are interrupted by a radial slot.

* * * * *